US012319457B2

(12) United States Patent
Lin

(10) Patent No.: US 12,319,457 B2
(45) Date of Patent: Jun. 3, 2025

(54) AUTOMATIC PACKAGING MACHINE FOR PAPER BAGS

(71) Applicant: Yun Yu Lin, Chiayi (TW)

(72) Inventor: Yun Yu Lin, Chiayi (TW)

( * ) Notice: Subject to any disclaimer, the term of this patent is extended or adjusted under 35 U.S.C. 154(b) by 0 days.

(21) Appl. No.: 18/377,220

(22) Filed: Oct. 5, 2023

(65) Prior Publication Data

US 2024/0375805 A1 Nov. 14, 2024

(30) Foreign Application Priority Data

May 11, 2023 (TW) ..... 112204756

(51) Int. Cl.
*B65B 43/16* (2006.01)
*B65B 43/02* (2006.01)
*B65B 51/02* (2006.01)

(52) U.S. Cl.
CPC ..... *B65B 43/16* (2013.01); *B65B 43/02* (2013.01); *B65B 51/023* (2013.01)

(58) Field of Classification Search
CPC ..... B65B 43/16; B65B 43/02; B65B 51/023; B65B 25/14; B65B 63/02; B65B 11/10; B65B 27/08; B65B 25/145; B65H 2301/4223; B65H 2301/42266; B65H 2701/191; B65H 31/3081; B65H 31/3063; B65H 33/16
See application file for complete search history.

(56) References Cited

U.S. PATENT DOCUMENTS 2,768,489 A * 10/1956 Brown, Jr. ..... B65B 27/08 53/399
3,550,349 A * 12/1970 Breen ..... B65B 27/08 53/529
3,619,976 A * 11/1971 Kerker ..... B65B 27/08 53/529
3,720,040 A * 3/1973 Rocker ..... B65B 25/14 53/586
3,771,280 A * 11/1973 Bechle ..... B65B 11/22 53/461
3,938,304 A * 2/1976 Utsumi ..... B65B 45/00 53/229
4,074,508 A * 2/1978 Reid ..... B65B 27/08 83/171

(Continued)

*Primary Examiner* — Dariush Seif
(74) *Attorney, Agent, or Firm* — Chun-Ming Shih; LANWAY IPR SERVICES

(57) ABSTRACT

An automatic packaging machine for paper bags contains: a support platform, a rotation table, a stacking device, a displacement device, a packaging device, and a paper delivery device. The support platform includes multiple paper bags delivered thereon. The rotation table is configured to rotate the multiple paper bags at two opposite angles. The stacking device is configured to stack the multiple paper bags. The displacement device is mounted below the stacking device and is configured to deliver the multiple paper bags. The packaging device is connected on the displacement device and includes an entering platform, a press plate, and a glue sprayer. An inlet of the entering platform accommodates the press plate, and the glue sprayer is fixed on a predetermined position of the entering platform. The paper feeder is connected with the packaging device and is configured to deliver multiple packing papers onto the entering platform.

5 Claims, 9 Drawing Sheets

(56) References Cited

U.S. PATENT DOCUMENTS

| | | | | | |
|---|---|---|---|---|---|
| 4,331,415 | A * | 5/1982 | Blatz | B65G 57/302 | 414/791 |
| 4,481,751 | A * | 11/1984 | Ujhelyi | B65B 25/14 | 53/446 |
| 4,683,708 | A * | 8/1987 | Linder | B65B 25/14 | 53/553 |
| 4,805,383 | A * | 2/1989 | Allwein | B65B 11/08 | 53/586 |
| 5,249,408 | A * | 10/1993 | Winnemoller | B65B 11/12 | 53/228 |
| 5,499,489 | A * | 3/1996 | Perobelli | B65H 31/3081 | 53/529 |
| 6,594,974 | B2 * | 7/2003 | Theriault | B65H 33/12 | 53/251 |
| 6,755,008 | B2 * | 6/2004 | Schmetzer | B65B 5/067 | 53/529 |
| 7,503,153 | B2 * | 3/2009 | De Matteis | B65B 11/10 | 53/223 |
| 7,721,511 | B2 * | 5/2010 | De Matteis | B65B 25/14 | 53/529 |
| 11,518,563 | B2 * | 12/2022 | Gryxa | B65B 27/08 | |
| 2004/0011005 | A1 * | 1/2004 | Daoust | B65B 11/10 | 53/529 |
| 2024/0025583 | A1 * | 1/2024 | Christel | B65B 35/36 | |

* cited by examiner

AUTOMATIC PACKAGING MACHINE FOR PAPER BAGS

TECHNICAL FIELD

The present invention relates to an automatic packaging machine which is capable of packaging the multiple paper bags automatically to reduce package cost and enhance production efficiency.

BACKGROUND

A conventional packaging operation for bags is usually to facilitate transportation of the bags and subsequent filling operations.

Generally speaking, the packaging methods of bags are divided into two types: paper and plastic. Plastic packaging is more common. Its cost and the development of packaging machines are both low and mature, so it is a common choice on the market. However, as environmental awareness grows, plastic bags or outer casings are the first materials to be discarded. As for other paper materials, with the achievements of environmental recycling in recent years and the maturity of paper reuse technology, recycled paper has been widely developed and used. Therefore, the industry has transformed paper bags for future considerations, and paper bags are also a target for consideration, but the machine applications for paper and plastic outer bags are completely different. It is not a simple replacement of materials that can be effective. At present, most of them are manual packaging, and the process is difficult because the previous production capacity of plastic packaging, it was an unfavorable situation for the development of packaging factories. Therefore, manual packaging operations have greatly reduced work efficiency and are time-consuming and costly.

The present invention has arisen to mitigate and/or obviate the afore-described disadvantages.

SUMMARY

The primary aspect of the present invention is to provide an automatic packaging machine which is capable of packaging the multiple paper bags automatically to reduce package cost and enhance production efficiency To obtain above-mentioned aspect, an automatic packaging machine provided by the present invention contains: a support platform, a rotation table, a stacking device, a displacement device, a packaging device, and a paper delivery device.

The support platform includes multiple paper bags delivered thereon.

The rotation table is connected with the support platform and is configured to rotate the multiple paper bags at two opposite angles.

The stacking device is connected with the rotation table and is configured to stack the multiple paper bags which are rotated by the rotation table.

The displacement device is mounted below the stacking device and is configured to deliver the multiple paper bags.

The packaging device is connected on the displacement device, and the packaging device includes an entering platform, a press plate, and a glue sprayer, wherein an inlet of the entering platform accommodates the press plate, and the glue sprayer is fixed on a predetermined position of the entering platform.

The paper feeder is connected with the packaging device and is configured to deliver multiple packing papers onto the entering platform.

When the displacement device picks and displaces the multiple paper bags under an inlet of the packaging device, the multiple packing paper are fed and transported to a feeding platform of the packaging device by the paper feeder so that the displacement device displaces the multiple paper bags to the feeding platform, and the press plate of the packaging device presses the multiple paper bags and the multiple packaging papers to the displacement device, thereafter the multiple paper bags are moved upward with the multiple packaging papers so that the glue sprayer sprays glues to the multiple packing bags on the feeding platform, thus adhering the multiple paper bags with the multiple packing papers to produce multiple finished paper bags automatically.

Preferably, the support platform is connected with a bag manufacturing machine so as to package the multiple paper bags produced by the bag manufacturing machine.

Preferably, the packaging device includes a pusher disposed on a side thereof and configured to push the multiple paper bags which are packaged to a designated location.

Preferably, the stacking device is configured to stack the multiple paper bags which are rotated by the rotation table by moving downward.

Preferably, the displacement device includes a clamper and a rail on which the clamper is mounted and moves horizontally, and the clamper is configured to move vertically and to clamp the multiple paper bags securely.

DETAILED DESCRIPTION

Figure 1:
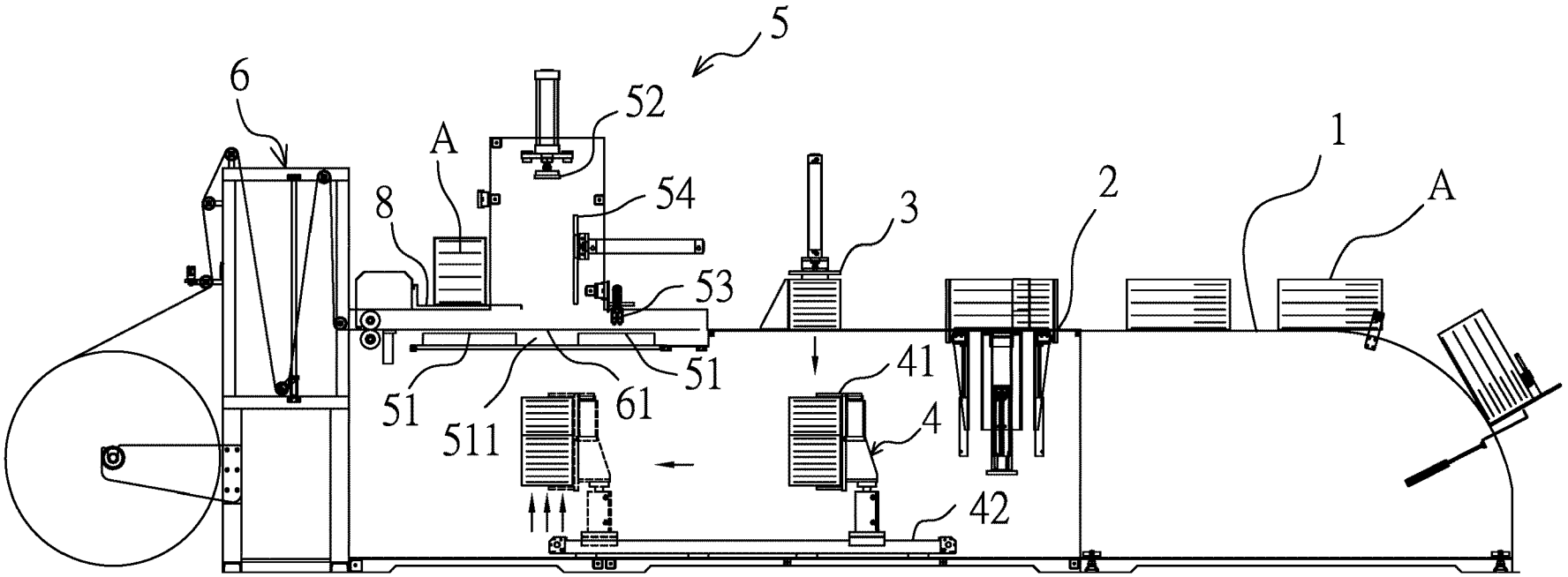
FIG. 1 is a side plan view showing the assembly of an automatic packaging machine according to a preferred embodiment of the present invention.

With reference to FIG. 1, an automatic packaging machine for paper bags according to a preferred embodiment of the present invention comprises: a support platform 1, a rotation table 2, a stacking device 3, a displacement device 4, a packaging device 5, and a paper delivery device 6.

The support platform 1 includes multiple paper bags A delivered thereon.

The rotation table 2 is connected with the support platform 1 and is configured to rotate the multiple paper bags A at two opposite angles.

The stacking device 3 is connected with the rotation table 2 and is configured to stack the multiple paper bags which are rotated by the rotation table by moving downward.

The displacement device 4 is mounted below the stacking device 3 and is configured to deliver the multiple paper bags A, and the displacement device 4 includes a clamper 41 and a rail 42 on which the clamper 41 is mounted and moves horizontally, wherein the clamper 41 is configured to move vertically and to clamp the multiple paper bags A securely.

The packaging device 5 is connected on the displacement device 4, and the packaging device 5 includes an entering platform 51, a press plate 52, and a glue sprayer 53, wherein an inlet 511 of the entering platform 51 accommodates the press plate 52, and the glue sprayer 53 is fixed on a predetermined position of the entering platform 51.

The paper feeder 6 is connected with the packaging device 5 and is configured to deliver multiple packing papers 61 onto the entering platform 51.

Figure 10:
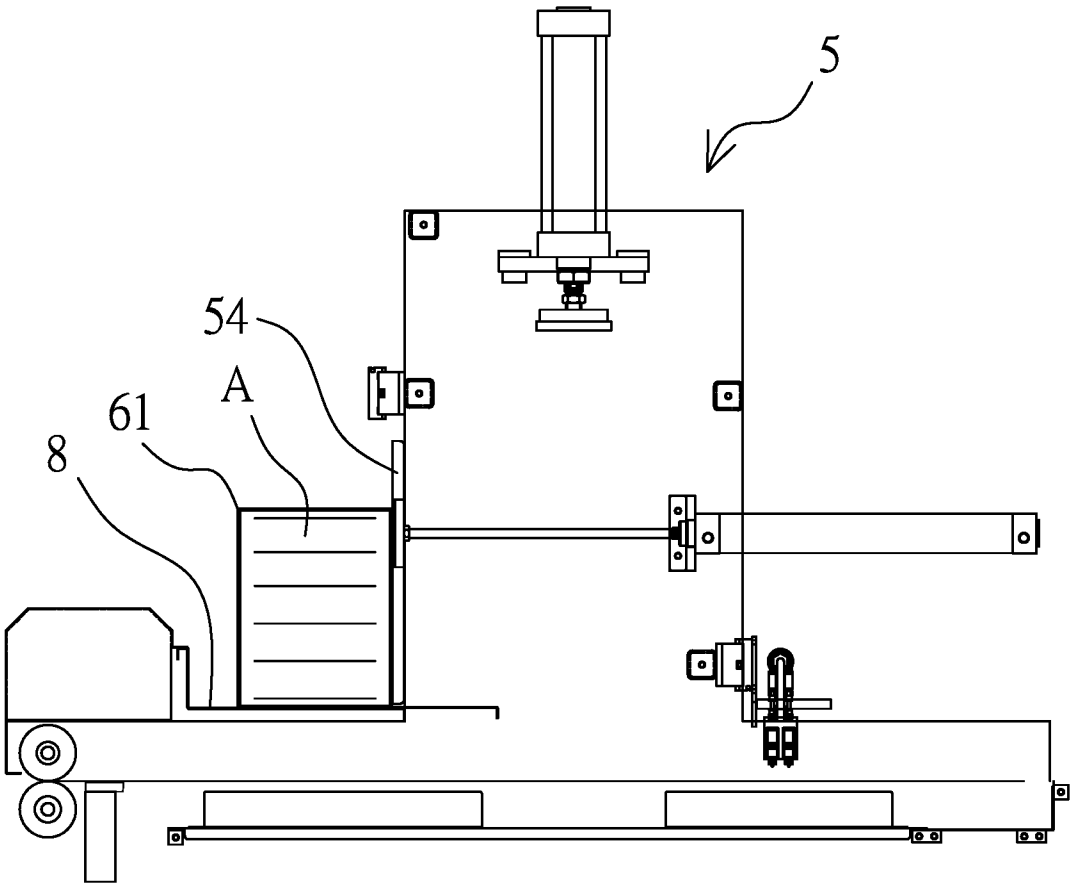
FIG. 10 is a front plan view showing the operation of the pusher of the automatic packaging machine according to the preferred embodiment of the present invention.

The packaging device 5 includes a pusher 54 disposed on a side thereof and configured to push the multiple paper bags which are packaged to a designated location, as shown in FIG. 10.

Figure 11:
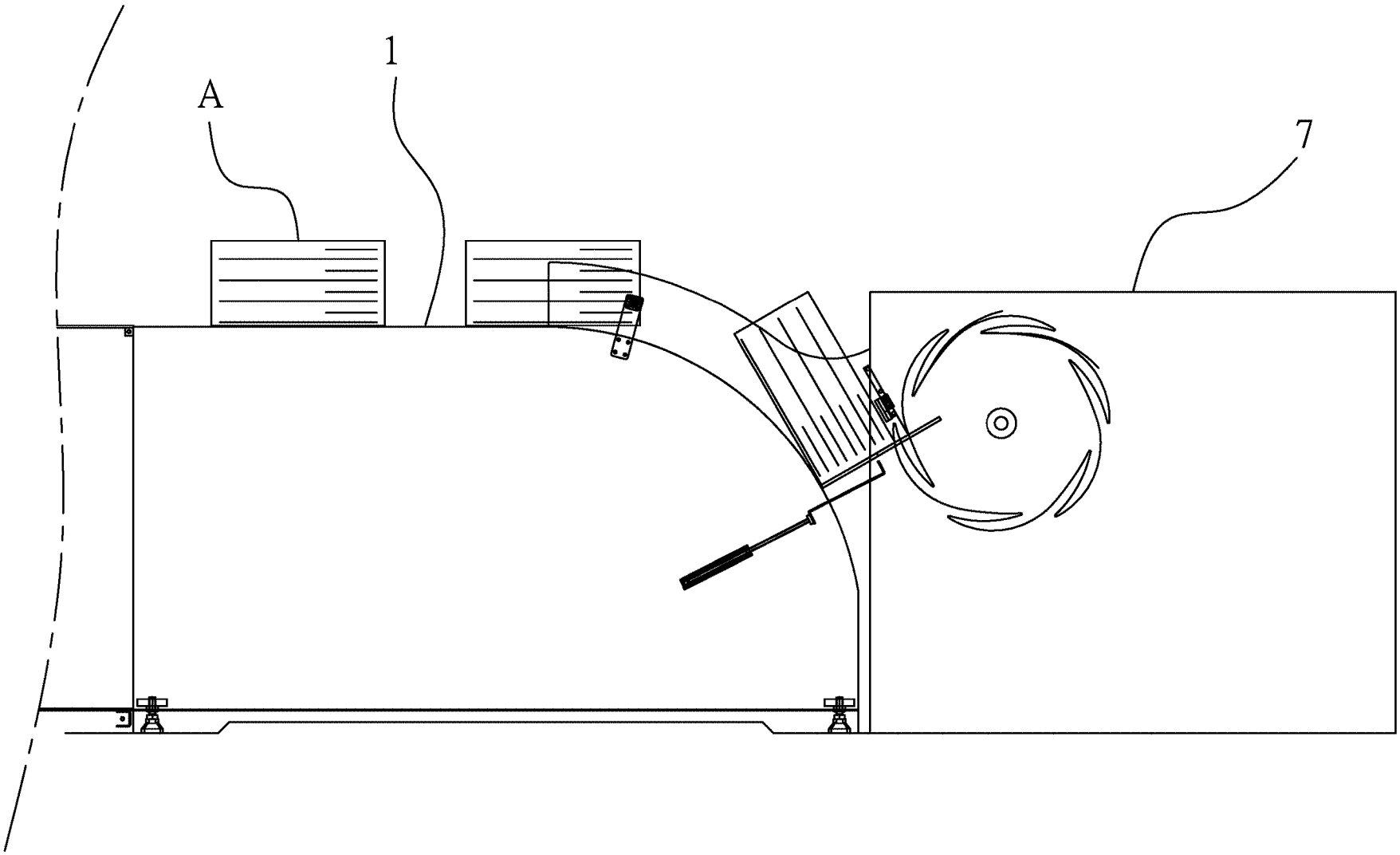
FIG. 11 is a front plan view showing the operation of the support platform of the automatic packaging machine according to the preferred embodiment of the present invention.

The support platform 1 is connected with a bag manufacturing machine 7 so as to package the multiple paper bags produced by the bag manufacturing machine 7, as shown in FIG. 11.

Figure 2:
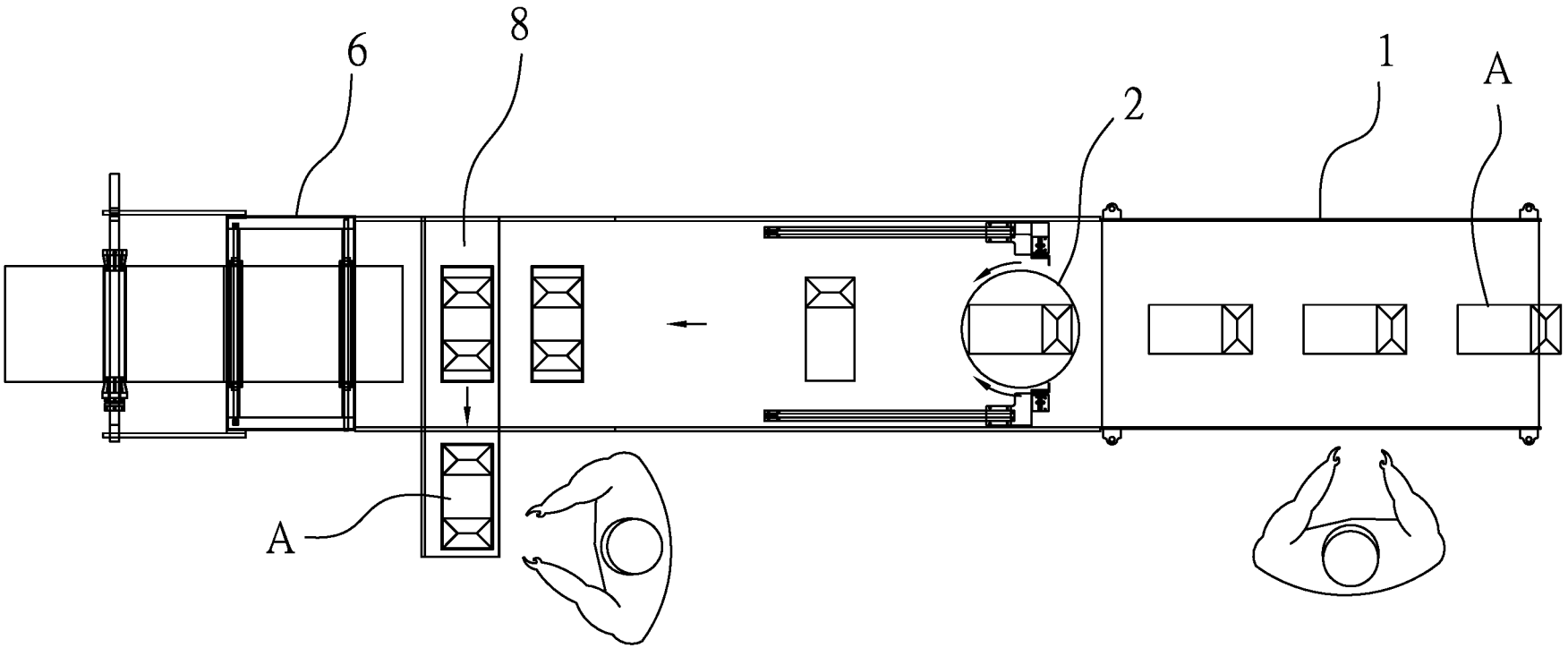
FIG. 2 is a top plan view showing the assembly of the automatic packaging machine according to the preferred embodiment of the present invention.
Figure 3:
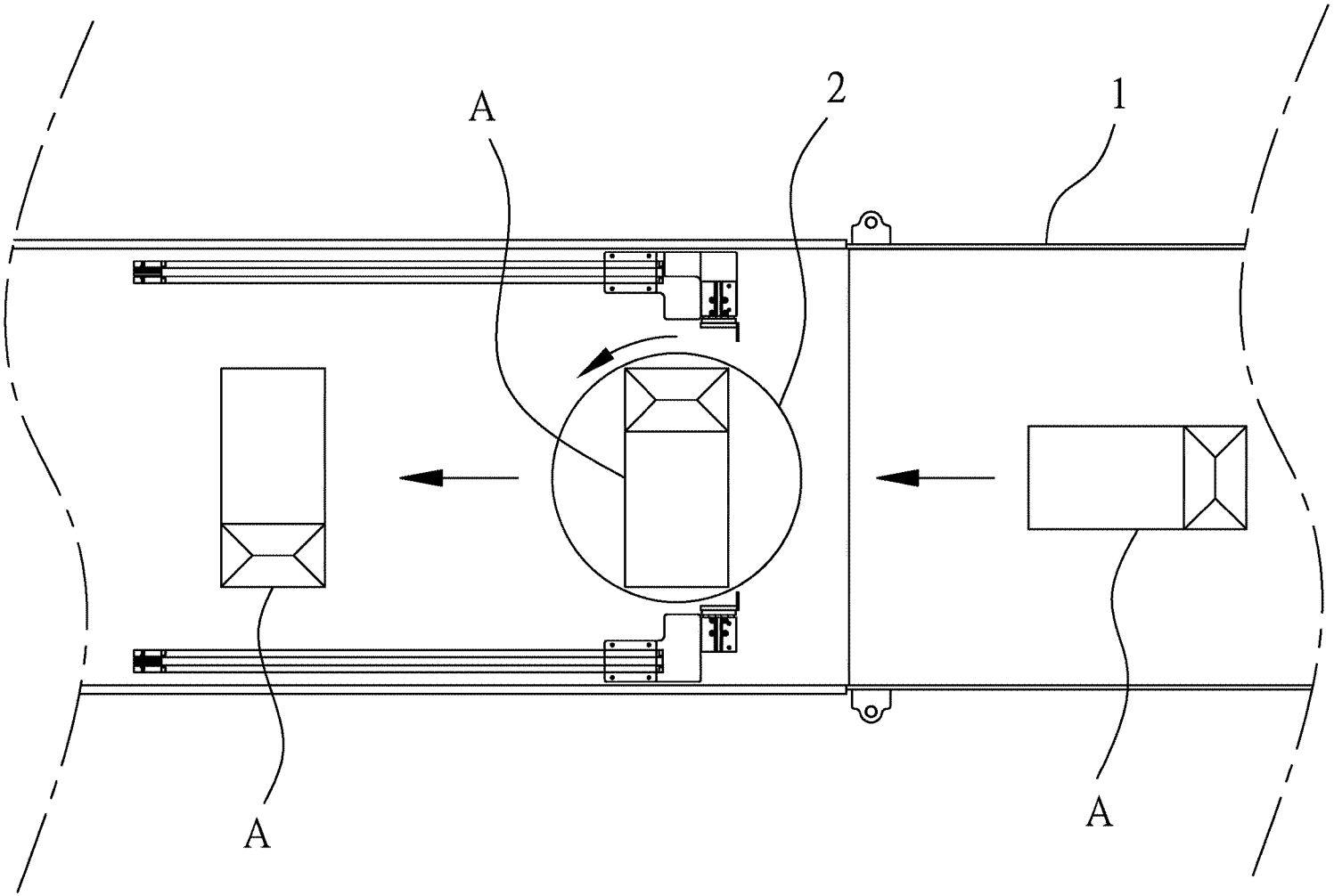
FIG. 3 is a top plan view showing the operation of the rotation table of the automatic packaging machine according to the preferred embodiment of the present invention.
Figure 4:
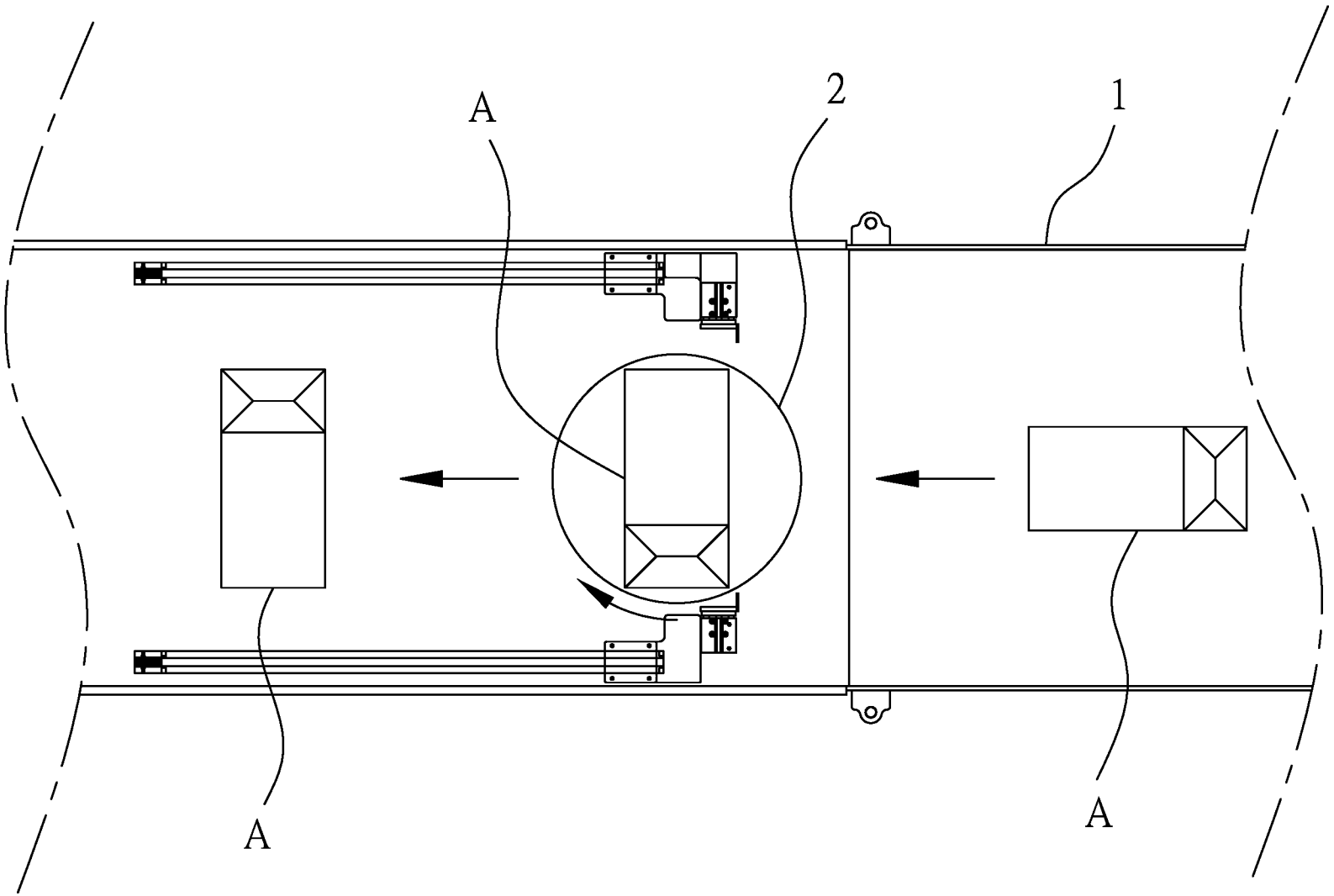
FIG. 4 is another top plan view showing the operation of the rotation table of the automatic packaging machine according to the preferred embodiment of the present invention.
Figure 5:
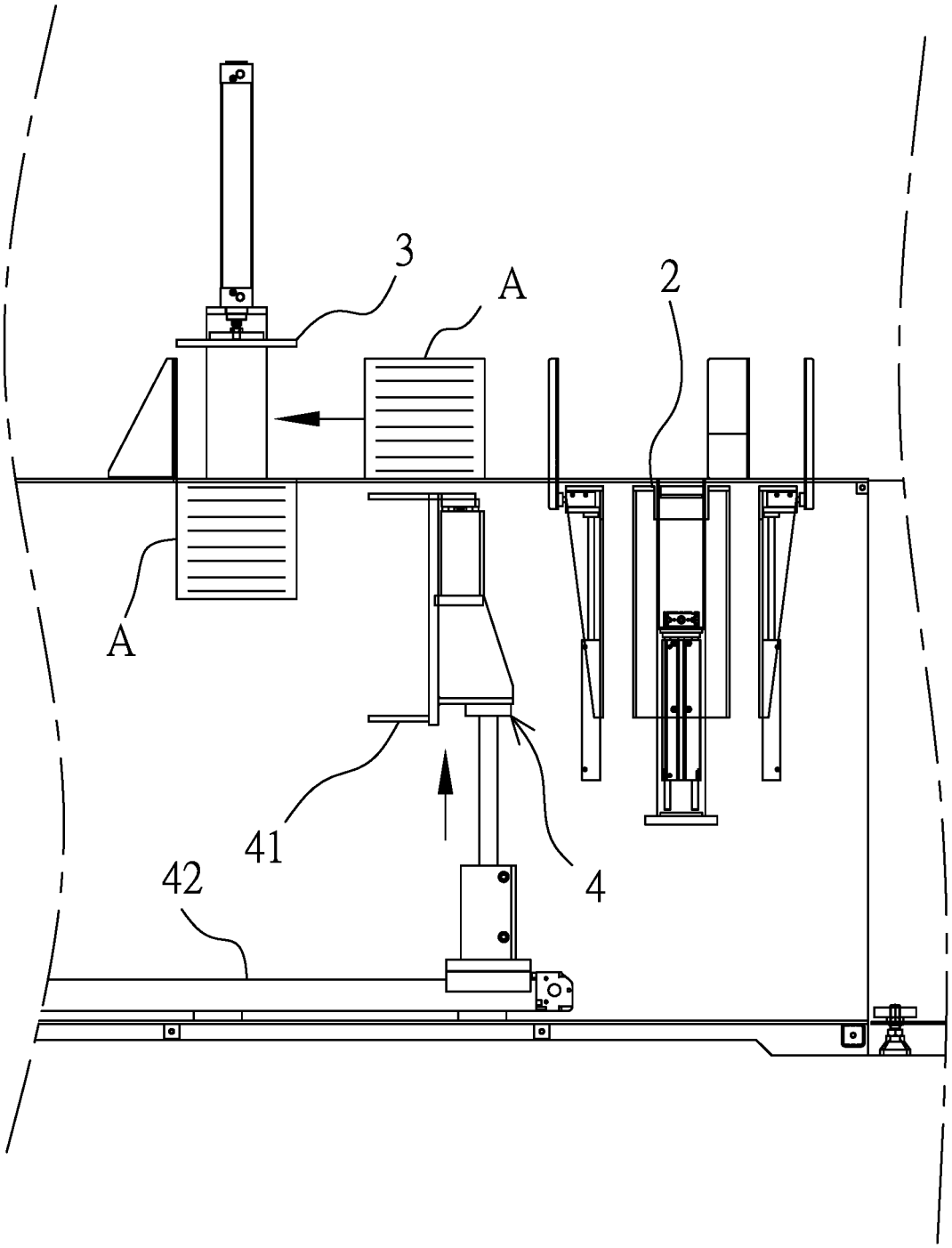
FIG. 5 is a front plan view showing the operation of the stacking device and the displacement device of the automatic packaging machine according to the preferred embodiment of the present invention.
Figure 6:
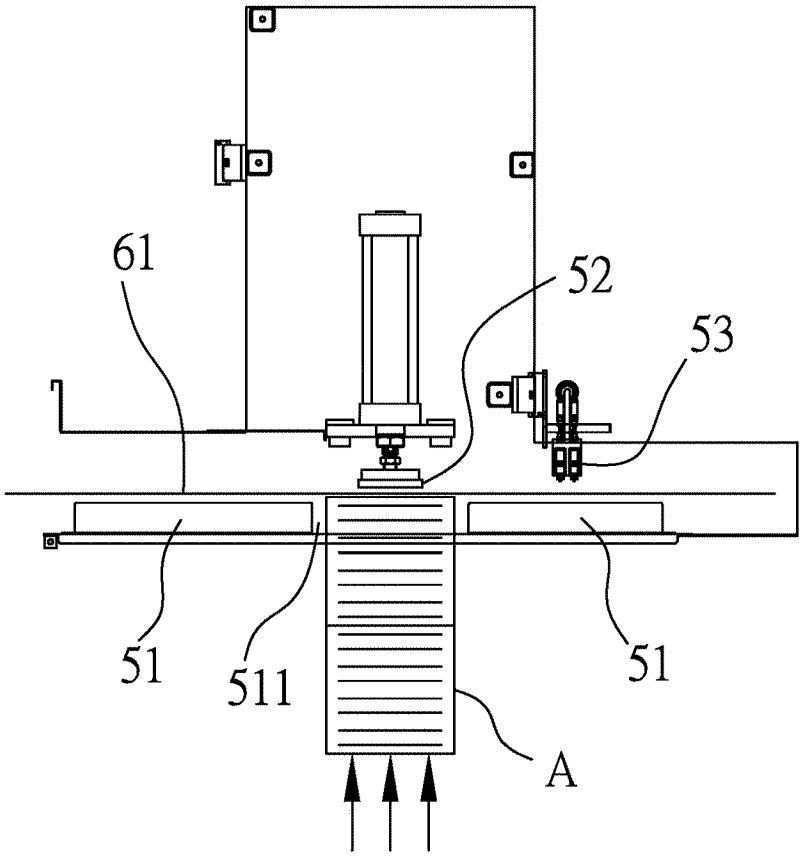
FIG. 6 is a front plan view showing the operation of the packaging device of the automatic packaging machine according to the preferred embodiment of the present invention.
Figure 7:
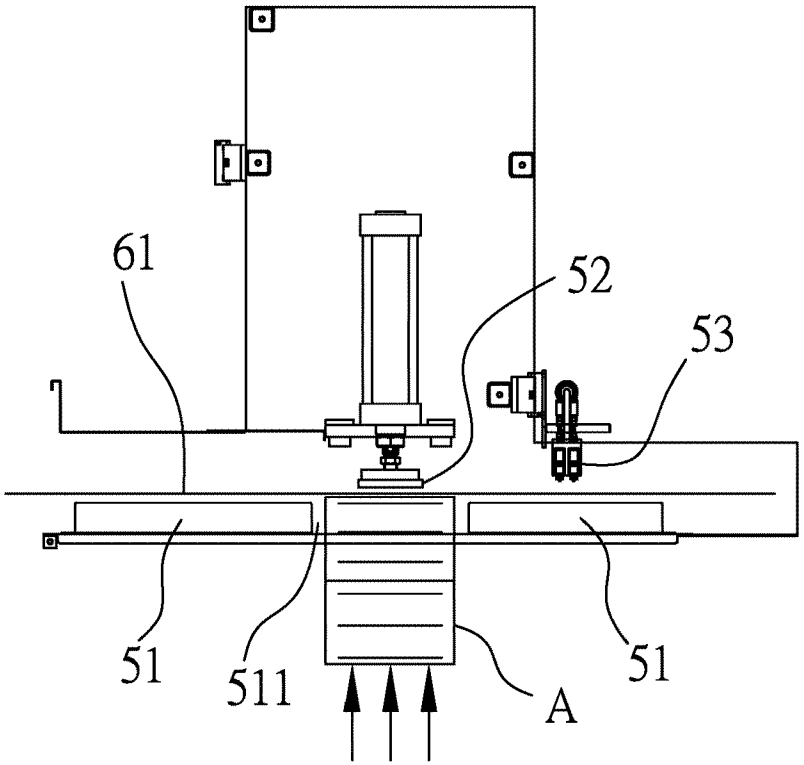
FIG. 7 is another front plan view showing the operation of the packaging device of the automatic packaging machine according to the preferred embodiment of the present invention.
Figure 8:
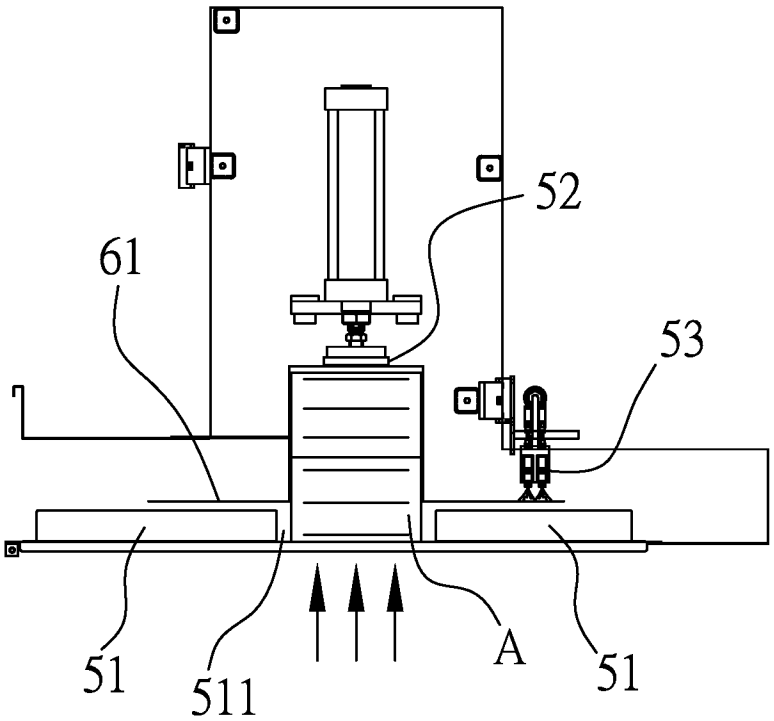
FIG. 8 is also another front plan view showing the operation of the packaging device of the automatic packaging machine according to the preferred embodiment of the present invention.
Figure 9:
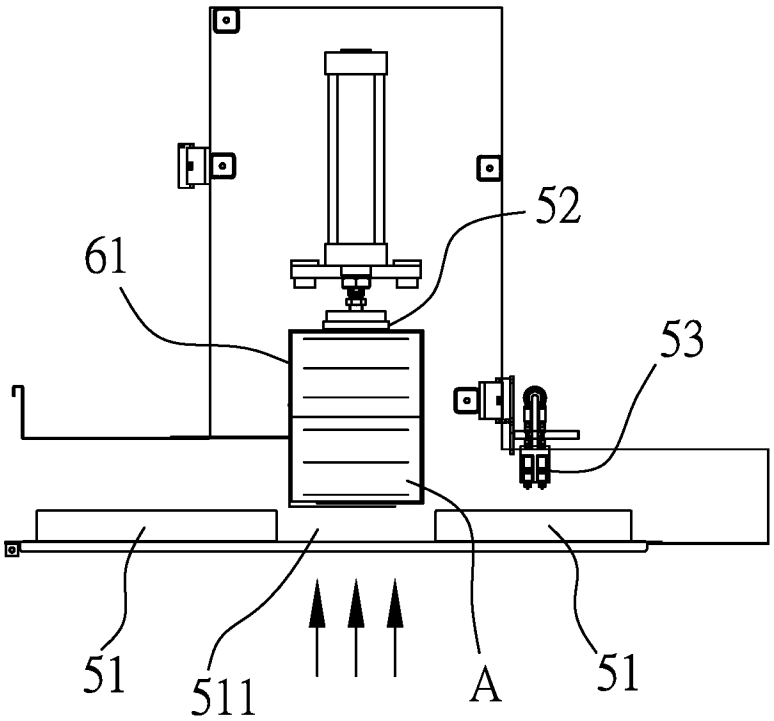
FIG. 9 is still another front plan view showing the operation of the packaging device of the automatic packaging machine according to the preferred embodiment of the present invention.

Referring to FIGS. 1 and 2, in operation, the multiple paper bags A are delivered on the support platform 1, and a worker stands beside the support platform 1 to inspect whether the multiple paper bags have defects, such as skewed bags or damaged bags. Before the multiple paper bags are carried to the rotation table 2 (also as illustrated in FIGS. 3-4), a direction of an opening of the multiple paper bags A faces forward or rearward. After the multiple paper bags are delivered into the rotation table 2, the multiple paper bags are rotated to 90 degrees so that the opening of the multiple paper bags A are in a left or right side, then the multiple paper bags A are moved to the stacking device 3 (as shown in FIG. 5) and are displaced downward so that a highest position of the multiple paper bags A is parallel to the automatic packaging machine, and the rotation table 2 holds the multiple paper bags continuously, wherein some paper bags which are rotated last time in a direction are opposite to the other paper bags which are rotated this time in another direction. For example, same paper bags are rotated last time in a left direction, and the other paper bags are rotated this time in a right direction. Thereafter, the multiple paper bags A are delivered to the stacking device 3 and are stacked to a predetermined height so that the displacement device 4 picks and displaces the multiple paper bags under an inlet of the packaging device 5 (as illustrated in FIGS. 6-9). In the meantime, the multiple packing paper 61 are fed and transported to a feeding platform 51 of the packaging device 5 by the paper feeder 6 so that the displacement device 4 displaces the multiple paper bags A to the feeding platform 51, and the press plate 52 of the packaging device 5 presses the multiple paper bags A and the multiple packaging papers 61 to the displacement device 4. Thereafter, the multiple paper bags A are moved upward with the multiple packaging papers 61 so that the glue sprayer 53 sprays glues to the multiple packing bags 61 on the feeding platform 51, thus adhering the multiple paper bags A with the multiple packing papers 61 to produce multiple finished paper bags automatically.

Thereafter, the packaging device 5 packages the multiple finished paper bags A and pushes the multiple finished paper bags A to a product collection platform 8 so that the worker collects and stores the multiple finished paper bags A.

Accordingly, the automatic packaging machine is capable of packaging the multiple paper bags automatically to reduce package cost and labor consumption.

While the first embodiments of the invention have been set forth for the purpose of disclosure, modifications of the disclosed embodiments of the invention as well as other embodiments thereof may occur to those skilled in the art. The scope of the claims should not be limited by the first embodiments set forth in the examples, but should be given the broadest interpretation consistent with the description as a whole.

What is claimed is:

1. An automatic packaging machine for paper bags comprising:

a support platform including multiple paper bags delivered thereon;

a rotation table connected with the support platform and configured to rotate the multiple paper bags at two opposite angles;

a stacking device connected with the rotation table and configured to stack the multiple paper bags which are rotated by the rotation table;

a displacement device mounted below the stacking device to deliver the multiple paper bags;

a packaging device connected with the displacement device, and the packaging device including an entering platform, a press plate, and a glue sprayer, wherein an inlet of the entering platform accommodates the press plate, and the glue sprayer is fixed on a predetermined position of the entering platform; and a paper feeder connected with the packaging device and configured to deliver multiple packing papers onto the entering platform;

wherein the multiple paper bags are delivered on the support platform so as to be inspected whether the multiple paper bags have defects, wherein before the multiple paper bags are carried to the rotation table, a direction of an opening of the multiple paper bags faces forward or rearward, after the multiple paper bags are delivered into the rotation table, the multiple paper bags are rotated to 90 degrees so that the opening of the multiple paper bags are in a left or right side, then the multiple paper bags are moved to the stacking device and are displaced downward so that a highest position of the multiple paper bags is parallel to the automatic packaging machine, and the rotation table holds the multiple paper bags continuously, wherein some paper bags which are rotated last time in a direction are opposite to the other paper bags which are rotated this time in another direction, thereafter the multiple paper bags are delivered to the stacking device and are stacked to a predetermined height so that the displacement device picks and displaces the multiple paper bags under an inlet of the packaging device, and the multiple packing paper are fed and transported to an entering platform of the packaging device by the paper feeder so that the displacement device displaces the multiple paper bags to the entering platform, and the press plate of the packaging device presses the multiple paper bags and the multiple packaging papers to the displacement device, thereafter the multiple paper bags are moved upward with the multiple packaging papers so that the glue sprayer sprays glues to the multiple packing bags on the entering platform, thus adhering the multiple paper bags with the multiple packing papers to produce multiple finished paper bags.

2. The automatic packaging machine as claimed in claim 1, wherein the support platform is connected with a bag manufacturing machine so as to package the multiple paper bags produced by the bag manufacturing machine.

3. The automatic packaging machine as claimed in claim 1, wherein the packaging device includes a pusher disposed on a side thereof and configured to push the multiple paper bags which are packaged to a designated location.

4. The automatic packaging machine as claimed in claim 1, wherein the stacking device is configured to stack the multiple paper bags which are rotated by the rotation table by moving downward.

5. The automatic packaging machine as claimed in claim 1, wherein the displacement device includes a clamper and a rail on which the clamper is mounted and moves horizontally, and the clamper is configured to move vertically and to clamp the multiple paper bags securely.

* * * * *